US006468394B1

(12) United States Patent
Sekiya et al.

(10) Patent No.: US 6,468,394 B1
(45) Date of Patent: Oct. 22, 2002

(54) METHOD OF PREVENTING OVER-ADHESION OF PAPER ONTO PRESS ROLL OF PAPER MACHINE

(75) Inventors: Kunio Sekiya; Hiroshi Sekiya, both of Tokyo (JP)

(73) Assignee: Maintech Co., Ltd., Tokyo (JP)

( * ) Notice: Subject to any disclaimer, the term of this patent is extended or adjusted under 35 U.S.C. 154(b) by 0 days.

(21) Appl. No.: 09/701,678

(22) PCT Filed: Mar. 31, 2000

(86) PCT No.: PCT/JP00/02116

§ 371 (c)(1),
(2), (4) Date: Nov. 30, 2000

(87) PCT Pub. No.: WO00/58550

PCT Pub. Date: Oct. 5, 2000

(30) Foreign Application Priority Data

Mar. 31, 1999 (JP) ..... 11-094404

(51) Int. Cl.[7] ..... D21H 19/00

(52) U.S. Cl. ..... 162/135; 162/172; 427/384; 106/2

(58) Field of Search ..... 162/135, 172, 162/199; 106/2; 427/180, 384

(56) References Cited

U.S. PATENT DOCUMENTS 6,139,911 A * 10/2000 Vanhecke et al. ..... 427/180

FOREIGN PATENT DOCUMENTS

| | | |
|---|---|---|
| EP | 087641 | 9/1983 |
| EP | 0481 321 B1 | 5/1996 |
| JP | 4-146290 | 5/1992 |
| JP | 4-146291 | 5/1992 |
| JP | 7-279081 | 10/1995 |
| JP | 7-109076 | 11/1995 |
| JP | 7-111036 | 11/1995 |
| JP | 11-513758 | 11/1999 |
| WO | WO 97/15646 | 5/1997 |

* cited by examiner

*Primary Examiner*—Dean T. Nguyen
(74) *Attorney, Agent, or Firm*—Flynn, Thiel, Boutell & Tanis, P.C.

(57) ABSTRACT

An object of the present invention is to provide a method of preventing the over-adhesion of paper onto the surface of a press roll for a long time and preventing both wear and contamination in a paper machine. To do so, there is adopted a method of, in a press roll in a state in which paper is being supplied by driving a paper machine, preventing the over-adhesion of the paper onto a surface of the press roll, wherein wax whose melting point is lower than the surface temperature of the press roll is continuously supplied to a direct surface of the rotating press roll by the amount of 0.01 to 10 mg/m$^2$, that is a calculation on the basis of passing paper.

11 Claims, 7 Drawing Sheets

METHOD OF PREVENTING OVER-ADHESION OF PAPER ONTO PRESS ROLL OF PAPER MACHINE

TECHNICAL FIELD

This invention relates to a press roll used for a paper machine and, more particularly, to a method of, in a press roll used for a paper machine, preventing paper from over-adhering (i.e., stubbornly clinging) onto the surface of the press roll.

BACKGROUND ART

In a paper machine, a sheet of wet paper is made from raw materials, and, after removing water from the wet paper, it is made into finished goods.

In order to remove water, dehydration/drying is essential.

A dehydrating process, i.e., a so-called "pressing part" is supremely important because the extent to which the wet paper can be dehydrated exerts a great influence upon a load allocated to a subsequent drying process, in other words, upon steam consumption (energy cost) during a "dry part".

In the pressing part of the paper machine, there are about 2 to 4 places where paper (wet paper) is dehydrated while being pressed firmly by a pair of press rolls and a felt.

The wet paper and the felt are placed on each other and are sandwiched between the pair of press rolls, and thereafter nip pressure is applied between the rolls, so that water in the paper moves to the felt side and is removed.

The press rolls make a pair by two kinds of rolls one of which comes in contact with the wet paper and the other one comes in contact with the felt.

On the wet paper side of the two sides, a hard-rubber-made roll that can easily conform to paper and has smoothness, or a natural stone roll, or an artificial stone roll (so-called stone roll) is used since great importance is attached to the releasability of paper.

Especially in recent years, as paper machines speed up, a ceramic-made artificial stone roll that is cheaper than the aforementioned stone roll and utilizes the characteristics of the stone roll has come to be increasingly used.

(Over-adhesion Phenomenon)

By the way, paper is supplied to the press roll by driving the paper machine. In the press roll in the state where paper is being supplied, a considerable problem has resided in that, if press rolls like the aforementioned ones are used, the paper causes over-adhesion onto its surface. (Herein, the term "over-adhesion" denotes the state of clinging stubbornly.)

More specifically, after passing over a nip point of the paper-side press roll of the pair of press rolls, normally, the paper is swiftly released from its surface. However, there occurs a phenomenon in which the paper rotates in a dragged state while adhering to the surface of the roll even if the paper has gone beyond the releasing point to a considerable extent.

FIG. 7 shows positions X1 and X2 where the phenomenon of over-adhesion of the paper onto the surfaces of press rolls occurs in the pressing part.

FIG. 8 is an enlarged view that shows the over-adhesion phenomenon.

Paper 2 adheres onto the surface of the press roll and is not released therefrom in spite of having gone past a normal ideal releasing point Q. A paper releasing point P appears past the ideal releasing point Q.

Therefore, the paper 2 is pulled by the following roll 1A when the paper 2 that has gone out of the press roll 1 is detached from the surface thereof, whereby tension (what is called "draw") is generated.

It is preferable that this "draw" be smaller. However, the draw has a tendency to become great as the paper releasing point P becomes high (i.e., a releasing angle a becomes wide) as shown in FIG. 8.

The reason is that the draw maintains a balance at the position of the paper releasing point P.

If the draw becomes great, sheet break may occur, and, as a result, productivity will decrease.

Even in a case where such sheet break does not occur, disadvantages in quality, such as growth of curl or reduction in paper width, will increase.

In a recent paper machine that is faster, wet paper moves at a higher speed, and therefore the draw is required to be raised for this condition.

Thus, it is a present objective to lower the draw, in other words, to prevent over-adhesion as much as possible.

(Sticking of Deposits)

On the other hand, paper contains various contents, such as pitch, tar, and fine fibers that are included in the raw pulp material itself, and sticky materials that are produced from recycled waste paper, added agents and loading materials that are included in various paper, and so forth.

These contents reach a pressurized, heated state when the paper is pressed by high nip pressure against the surface of the press roll during dehydration, and thus they are apt to firmly adhere onto the surface thereof and be contaminated.

The firmly stuck contents have the action of stripping off fibers on the surface of the paper, thereby causing the fluffing of the paper, and, if the fibers that have been stripped off increase greatly, dents will be made in the wet paper.

(Wear)

Normally, a method of scraping contaminants or deposits off by the blade of a doctor that is an attachment of the press roll is dominant, in order to remove deposits such as those mentioned above, that have been firmly stuck to the surface of the press roll.

However, the roll surface wears down and becomes rougher because of the pressed contact between the doctor blade and the surface of the press roll.

Accordingly, the deposits enter the rugged parts and undergo pressure, thus sticking firmly there.

As a result, they must be scraped off again with the doctor blade, which means the repetition of similar work, and a vicious cycle occurs.

From this fact, an attempt has been made to resolve the above defect as much as possible. For example, there is a case in which use is made of a press roll in which contamination prevention processing has been applied to its surface beforehand.

However, the contamination prevention effect diminishes as the paper machine is run, and therefore durability becomes inadequate. There is also a method of, for example, making the pressure of the doctor blade higher. However, although the deposits stuck firmly to the roll surface can be scraped off more easily according to this method, the doctor blade whose pressure has been heightened furthers the wear of the roll surface, and the doctor blade itself is also worn down thoroughly.

Therefore, the durability of the press roll and the doctor blade is lowered, and, as a result, the exchange cycle of them is also shortened (especially in a recent high-speed paper machine, the doctor blade must be exchanged once every three to seven days, depending partly on the material of the doctor blade).

Additionally, reparatory work for the exchange accumulates a time loss, thus decreasing production efficiency. The over-adhesion phenomenon cannot be greatly decreased (prevented) according to the method of heightening the pressure of the doctor blade.

On the other hand, there is a method of, for example, forming a water pond at the blade edge of the doctor of the roll and forming a water film on the roll surface by the use of water that has passed through the pond so that sticky materials, such as pitch, or fine fibers do not gather on the roll surface.

However, the blade pressure of the doctor weakens unavoidably as a result of securing the passing of water, and the scraping ability cannot be fully exercised.

In other words, deposits that have already been stuck firmly to the roll surface are not removed easily.

Further, a case occurs in which, when deposits make inroads into the blade edge of the doctor, it is temporarily lifted, and, as a result, much water overflows from there so as to dampen the paper. This is contrary to the role of the pressing part that is to carry out dehydration primarily.

Furthermore, if paper does not have a uniform water distribution in the direction of an onward movement, it will become vastly inferior in quality.

If the recycling of waste paper advances and sticky materials or fine fibers in a raw material increase in the future, the method does not necessarily serve as a satisfactory countermeasure.

As mentioned above, the conventional countermeasures have both merits and demerits, and a method of lowering the over-adhesion of paper onto the surface of a press roll and preventing both wear and contamination has not yet developed.

The present invention is aimed at resolving the aforementioned problems.

That is, an object of the present invention is to provide a method of preventing the over-adhesion of paper onto the surface of a press roll for a long time and preventing both wear and contamination in a paper machine.

Disclosure of the Invention

Thus, as a result of actively extending our studies in order to achieve the object, the present inventors have found the fact that an extremely thin wax film can be always maintained on the surface of a press roll by continuing to supply a slight amount of wax to the press roll in such a way as to rub the wax thereonto and the fact that this wax film is effective for over-adhesion reduction, wear prevention, and contamination prevention, and, based on this view, the present inventors have come to complete this invention.

(1) In more detail, the present invention relates to a method of, in a press roll in a state in which paper is being supplied by driving a paper machine, preventing over-adhesion of the paper onto a surface of the press roll, wherein a fixed amount of paper release improving agents are continuously supplied directly to the surface of the rotating press roll.

(2) In the over-adhesion preventing method, the paper release improving agent is largely composed of wax.

(3) Alternatively, in the over-adhesion preventing method, a substance in which wax is emulsified with a surfactant is used as the paper release improving agent.

(4) In the over-adhesion preventing method, the melting point of wax used as the paper release improving agent is lower than the surface temperature of the press roll.

(5) Alternatively, in the over-adhesion preventing method, the melting point of wax used as the paper release improving agent is 60° C. or less.

(6) In the over-adhesion preventing method, wax used as the paper release improving agent comprises one or more kinds of substances that is or are selected from the group of paraffin wax, microcrystalline wax, vaseline, composite wax, alkane pure goods (C17–C27), α-olefine, alkene pure goods (C19–C29), and animal/plant base glycerides.

(7) In the over-adhesion preventing method, the paper release improving agent is supplied to the surface of the press roll by spraying.

(8) Further, the present invention relates to a method of, in a press roll in a state in which paper is being supplied by driving a paper machine, preventing over-adhesion of the paper onto the surface of the press roll, wherein wax whose melting point is lower than the surface temperature of the press roll is continuously supplied directly to the surface of the rotating press roll by the amount of 0.01 to 10 mg/m$^2$ that is a calculation on the basis of passing paper.

(9) Further, the present invention relates to a method of, in a press roll in a state in which paper is being supplied by driving a paper machine, preventing over-adhesion of the paper onto the surface of the press roll, the method comprising the following steps 1) to 4):

1) step of supplying wax directly to the surface of the rotating press roll,
2) step of forming a wax film such that wax is further supplied to the surface of the press roll and thereafter undergoes pressure so as to be melted (wax film formation step),
3) step of transferring the wax to the paper by firmly pressing the press roll and the paper to each other whereby a wax film layer is worn down (wax transfer step), and
4) step of replenishing the wax film layer with wax that is further supplied after the wax film layer has been worn down (wax replenishment step).

(Operation)

A fixed amount of wax continues to be constantly supplied to the surface of the press roll, and the wax spreads uniformly on the surface of the press roll, thus forming a wax film (layer).

This wax film is extremely thin and superior in releasability. In addition, this is stable when paper (wet paper) is pressed against the press roll by high pressure, and, when great nip pressure is applied, sticky materials and fine fibers on the wet paper are prevented from sticking firmly to the press roll.

Additionally, since the thin wax film that improves releasability is situated between the paper and the press roll when the paper is released from the press roll, the paper will come off with a smaller force, i.e., with lower draw.

After that, the wax of the wax film on the roll surface is transferred to the paper, whereas traces where the wax film has been worn down are replenished with new wax.

The present invention will be described with reference to the attached drawings, mentioning the modes carried out in the following.

Generally, a paper machine is provided with a dehydration part (i.e., pressing part), which comprises pickups for taking paper (wet paper) from over a wire, felts for absorbing the water of the paper, and press rolls between which the felt and the paper are inserted and pressed by high pressure.

FIG. 1 shows an example of the pressing part in the paper machine.

As the press roll 1 on the felt side, there is a suction roll provided with a suction device, or a grooved roll grooved in a circumferential direction, which is designed to accelerate water transfer from the felt 4.

And, as the press roll that directly presses the surface of the paper, a hard-rubber-made roll or a natural-granite-made stone roll or an artificial stone roll is used, which were described above.

The over-adhesion preventing method of the present invention is applied chiefly to the press roll built in the paper machine for directly pressing the paper surface.

In order to prevent contamination of the press roll, it is necessary to continuously and constantly supply a fixed amount of paper release improving agents to the direct surface of the press roll.

FIG. 2 is a part of the pressing part, showing a position (position of a nozzle S) where a paper release improving agent is supplied.

A substance composed largely of wax is mentioned as the paper release improving agent used in the present invention. In consideration of a normal surface temperature of the press roll 1 that is being run, a low melting point of 25 to 60° C. is suitable as the melting point of the wax.

As the wax, use is made of one or more kinds of substances selected from the group consisting of, for example, paraffin wax, microcrystalline wax, vaseline, composite wax, alkane pure goods (C17–C27), α-olefine, alkene pure goods (C19–C29), and animal/plant base glycerides.

Additionally, since the press roll 1 of the paper machine that is being driven presses the paper normally by high linear pressure (nip pressure) of 100 Kg/cm or more, it is preferable that a stable wax film be maintained under this pressure, and that the wax has releasability and non-property-modification.

Since wax that has a melting point lower than the surface temperature of the press roll 1 is used, the hollows of the rough surface can infallibly be filled with wax by receiving the heat and nip pressure of the press roll 1.

It is advantageous to add a surfactant and water to the wax to emulsify it with water when the wax is supplied.

In this state, the wax is 0.1 μm–1.0 μm in particle size, and, when sprayed, the wax can easily enter the hollows of the rough surface of the press roll.

Additionally, since the particles are each fine, the surface area increases, and the heat of the press roll raises the fusibility.

Herein, the surfactant must be the one that does not exert a bad influence, such as destruction of the surface size or bleach of the paper fibers, on paper products.

Specifically, polyoxyethylene alkyl ether, sorbitan fatty ester, etc., are used as the surfactant.

The mixing ratio of the surfactant is satisfied by the minimum amount required for emulsification. That is, an amount of 5 to 30% by weight with respect to wax is adopted.

Spraying is carried out concretely by properly using a paper release improving agent to which 50 to 5000 times as much water as wax is added, according to conditions of the paper quality, the press roll, and so forth.

The wax that exists as solid particles at a normal temperature is made to melt by the surface temperature of the press roll (note that the surface temperature rises somewhat by the frictional heat between the roll and the doctor or by the heat transmitted through the felt) and to become liquid after the wax has been sprayed onto the surface of the press roll. Therefore, the lower the melting point of the wax is than the surface temperature (for example, 70° C.) of the press roll, the better.

A spraying nozzle is practically used to supply the wax to the surface of the press roll.

Concerning a supply of the wax that is the principal constituent of the paper release improving agent, it is necessary to spray and add a slight amount of wax gradually in such a way as not to destroy a wax film formed on the surface of the press roll.

The supply of the wax constituent is 0.01 to 10 mg/m$^2$, and preferably 0.05 to 2 mg/m$^2$, which is calculated on the basis of passing paper.

If the supply is less than 0.01 mg/m$^2$, breakage occurs in the wax film, and a uniform wax film cannot be formed. On the other hand, if it exceeds 10 mg/m$^2$, wax is excessively transferred to the paper, and the printing properties of the paper worsen.

Now, a description will be provided of sequential steps for supplying a paper release improving agent composed largely of wax onto the direct surface of a press roll.

1) [Wax Supplying Step]

When a paper release improving agent composed largely of wax W is supplied to the cylindrical press roll 1, the other one of the pair of press rolls acts to press the paper against the press roll 1 with a felt therebetween. Accordingly, the wax W supplied to the press roll 1 receives pressure and is stuck to the surface of the press roll (A).

Rough rugged parts of the surface of the press roll are filled with the wax.

If the wax is dispersed in the form of fine particles (0.1 μm–1.0 μm) by a surfactant, the wax can easily enter the rugged parts.

2) [Wax Film Formation Step]

The wax W stuck to the surface of the press roll forms a thin wax film (about tens of microns) on the surface of the press roll 1 by continuously supplying wax (B). The supplied wax is melted by the surface heat of the press roll, and becomes a liquid wax film.

In this way, wax can form such a wax film if it has a melting point of a temperature slightly higher than room temperature, i.e., a temperature slightly lower than the surface temperature of the press roll.

3) [Wax Transfer Step]

On the other hand, the wax film formed on the surface of the press roll 1 continues to be pressed by paper that is being fed, whereby the wax W is constantly transferred to the paper little by little (transfer phenomenon).

Accordingly, the wax film formed on the press roll 1 is gradually worn down.

4) [Wax Replenishment Step]

However, since the wax W is still being supplied to the press roll, wax that corresponds to the worn and removed wax can be replenished soon. (D) Wax reduction and wax replenishment do not take place distinctively but they do take place correlatively and simultaneously.

As mentioned above, when wax continues to be supplied to a new press roll surface that is moving during the operation of a paper machine, steps 1) and 2) are carried out at an initial stage.

Subsequently, when it further continues to be supplied, steps 3) and 4) are carried out.

Thus, by following the four steps of the wax supplying step, the wax film formation step, the wax transfer step, and the wax replenishment step, the press roll surface reaches a state in which an unchangeable wax film is always formed thereon.

In this state, the releasability of the press roll surface rises, and thus the paper releasing point decreases, and therefore the draw decreases.

As a result, over-adhesion is prevented.

Additionally, a contamination prevention effect can be always maintained during the operation of the paper machine without having the disadvantage of the prior art method in which contamination prevention processing is beforehand applied to the press roll surface so that the contamination prevention effect diminishes due to the operation of the paper machine.

Since this wax film also serves as lubrication between the doctor blade and the press roll, both the doctor blade and the press roll are stopped from wearing down.

Therefore, the exchange cycle of the press roll or the doctor blade is lengthened.

Additionally, since the wax film is superior in releasability, deposits are prevented from sticking to the roll surface.

For this reason, the press roll surface can be always smooth and high releasability can be maintained.

Herein, a description will be provided of a method for supplying (more specifically, spraying) a paper release improving agent to the press roll surface in the present invention by way of suggestion.

FIGS. 3 to 5 typically show a method of spraying a paper release improving agent.

FIG. 3 shows a state of spraying the paper release improving agent from a long type spraying nozzle, FIG. 4 shows a state of spraying the paper release improving agent from a spraying nozzle (opposed type) of a chemical spraying device toward the press roll surface, and FIG. 5 shows a state of spraying the paper release improving agent from a mobile spraying nozzle.

By the way, FIG. 6 shows a chemical spraying device used to spray the paper release improving agent that is a chemical.

The chemical spraying device is to spray the paper release improving agent sent from a chemical tank 10 toward the press roll surface from a spraying nozzle S.

If necessary, water is taken in through a flowmeter 11, and is mixed with the chemical by a mixer 12, and thereafter the resulting mixture is simultaneously sprayed from the spraying nozzle S.

The spraying technique for spraying toward the press roll can be variously selected by modifying the spraying nozzle.

As described above, in the present invention, a wax film is formed and maintained on the surface of a press roll by always supplying a fixed amount of paper release improving agent. Therefore, the over-adhesion phenomenon of paper is prevented as much as possible, and the press roll can be prevented from being contaminated and worn down, and, as a result, the quality of paper to be manufactured can be improved.

Additionally, a doctor blade attached to the press roll is also prevented from being worn down, and its durability increases.

As a result, the frequency with which the press roll or the doctor blade is cleaned or exchanged decreases, thus requiring less maintenance.

Since the amount of wax to be sprayed is an important aspect of the present invention, the experimental results of spraying will be shown.

BEST MODE FOR CARRYING OUT THE INVENTION

Embodiment 1

Bel Baie multi-cylinder paper machine (made by Mitsubishi Heavy Industries)

In newsprint making, the machine was run for one month and a paper release improving agent was continuously sprayed onto a press surface (temperature of 75° C.) through a nozzle of a fixed type spraying device after a doctor blade.

The paper release improving agent used herein is a 10% emulsified water solution in which wax (paraffin wax, melting point of 60° C.) and a surfactant are mixed at the ratio of 8 to 2 by weight and are diluted ten times with water.

The 400-times-diluted solution was sprayed to the press roll surface by the fixed type spraying device at 2000 cc per minute (density of 1 g/cc).

Accordingly, the amount of wax supplied here is $$2000\ \text{g/minute} \times 1/400 \times 10/100 \times 8/10 = 0.4\ \text{g/minute}$$

The printability and quality of the paper (newsprint) produced during this time were inspected. However, there was no influence because of its minute amount of 0.2 mg/m$^2$.

The amount of wax sprayed here, calculated on the basis of passing paper (paper speed 1000 m/minute×paper width 2 m=amount of paper 200 m$^2$/minute), is $$0.4\ \text{g/minute} \times 1/2000\ \text{m}^2/\text{minute} \approx 0.2\ \text{mg/m}^2$$

Figure 1:
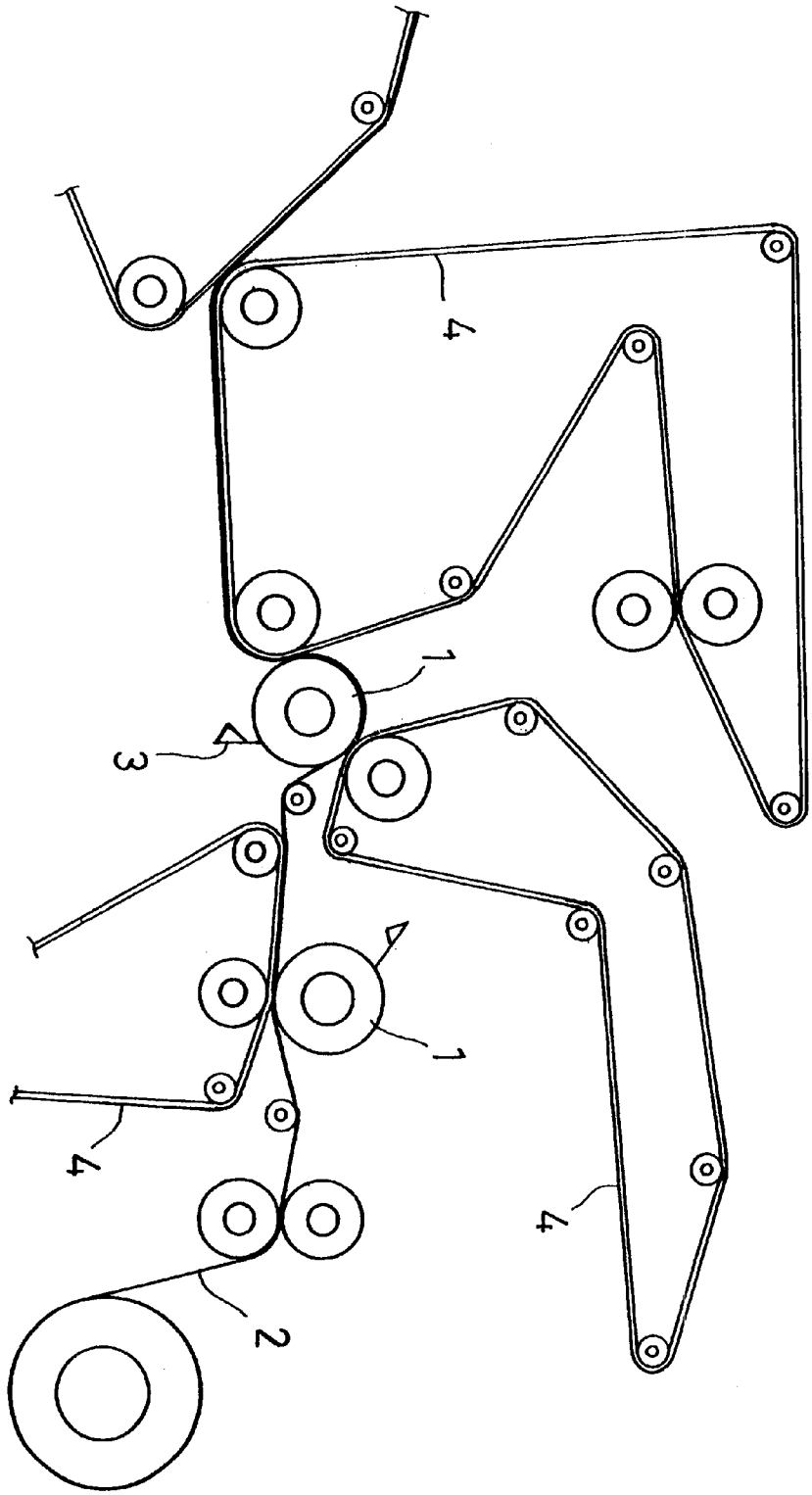
FIG. 1 shows an example of a pressing part in a paper machine.
Figure 2:
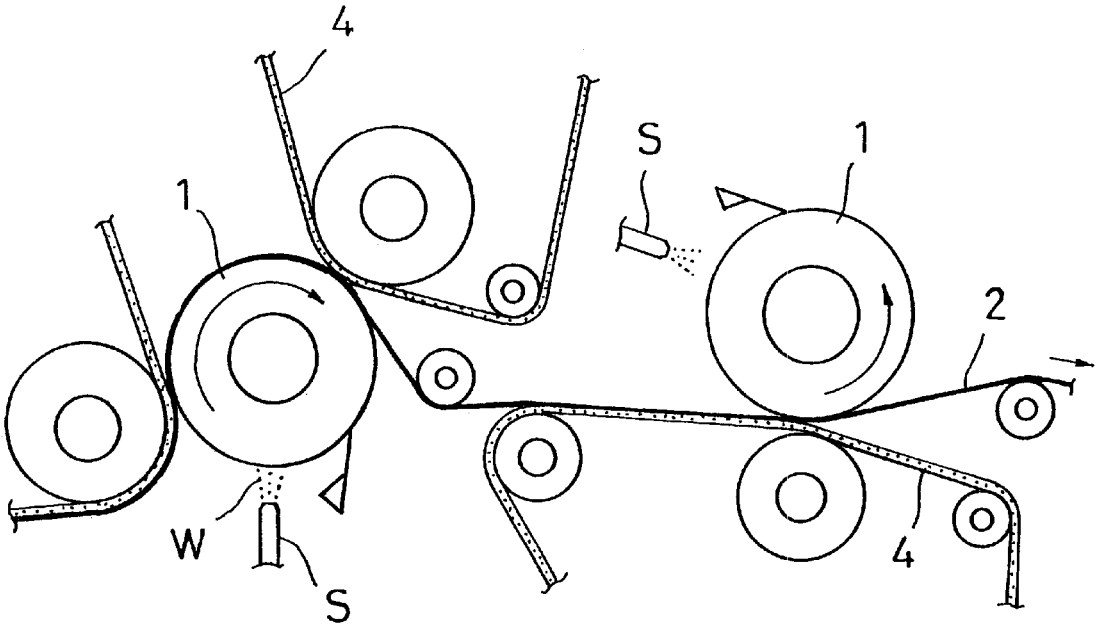
FIG. 2 shows a part of the pressing part, and positions where a paper release improving agent is supplied.
Figure 3:
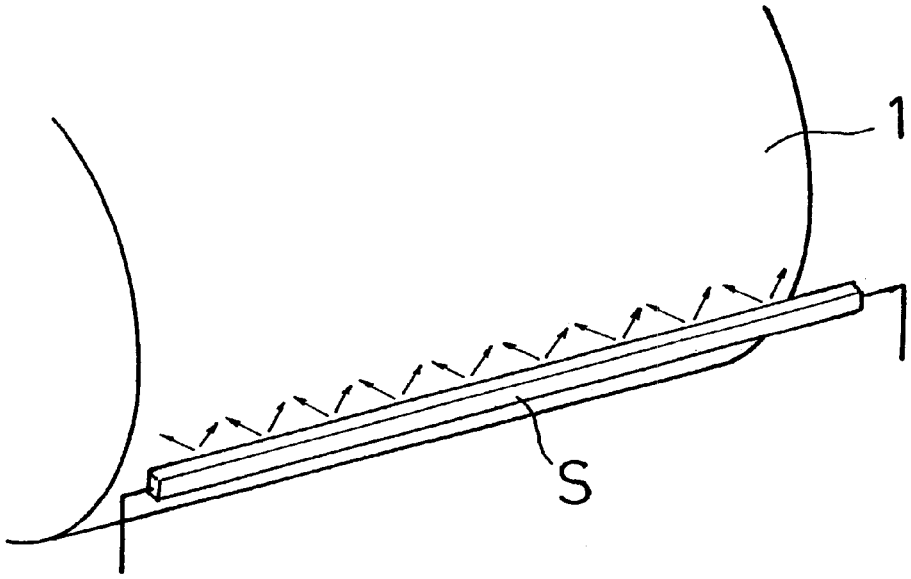
FIG. 3 shows spraying through a long type spraying nozzle.
Figure 4:
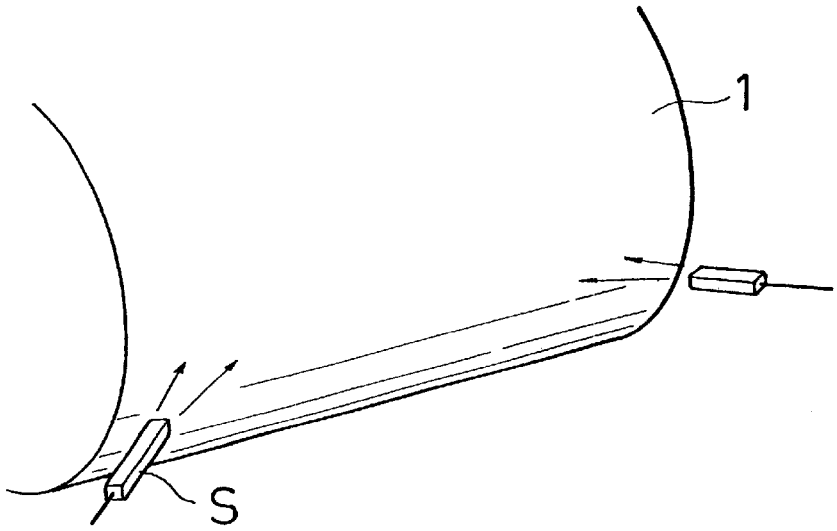
FIG. 4 shows spraying through an opposed type spraying nozzle.
Figure 5:
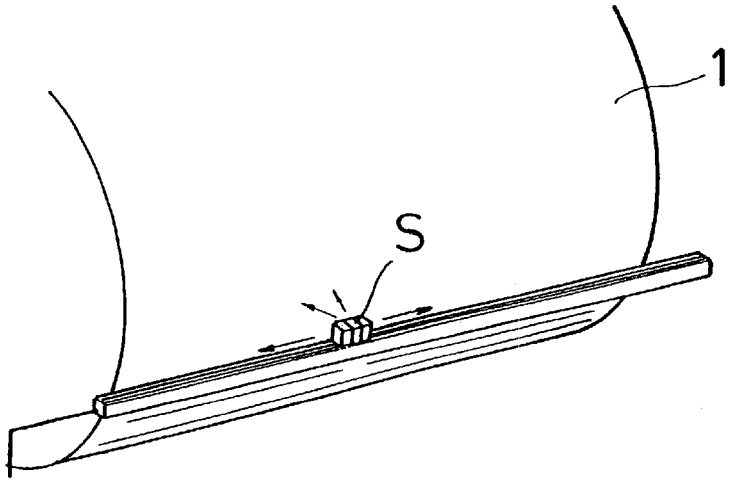
FIG. 5 shows spraying through a mobile spraying nozzle.
Figure 6:
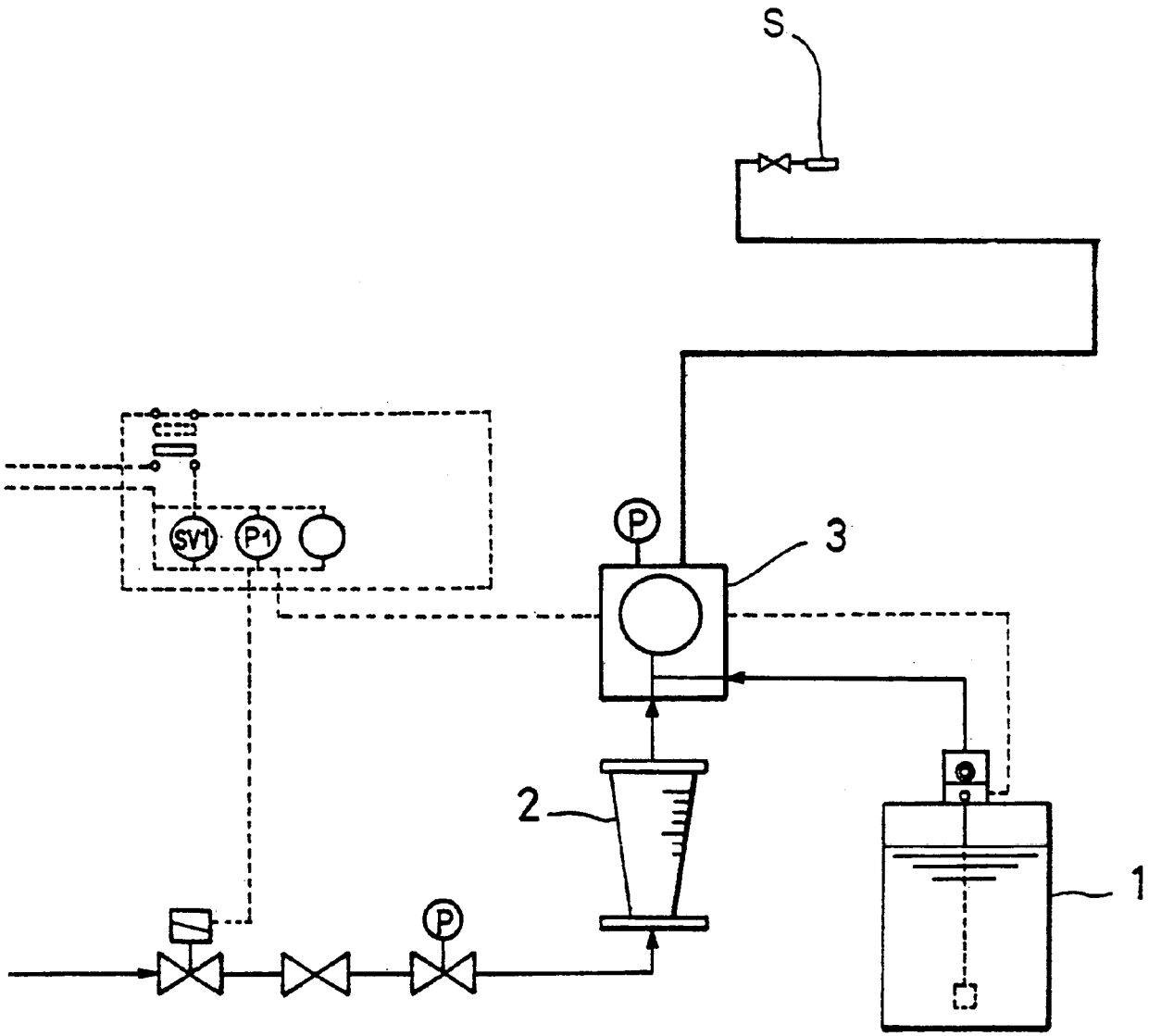
FIG. 6 shows a chemical-spraying device used to spray the paper release improving agent.
Figure 7:
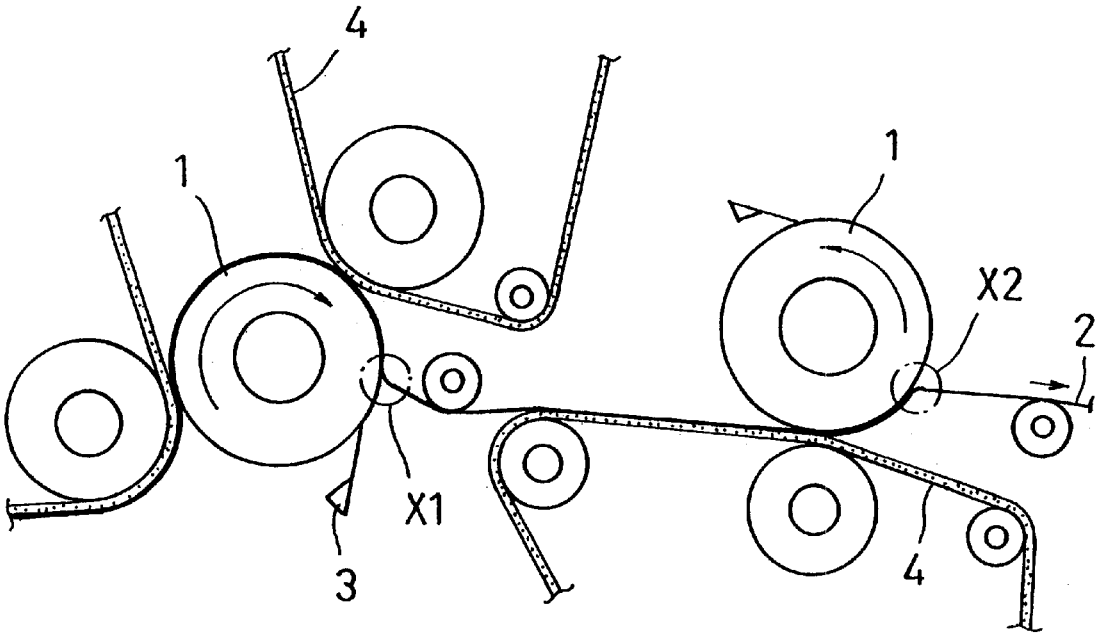
FIG. 7 shows positions X1 and X2 where the over-adhesion of paper onto a press roll surface occurs in the pressing part.
Figure 8:
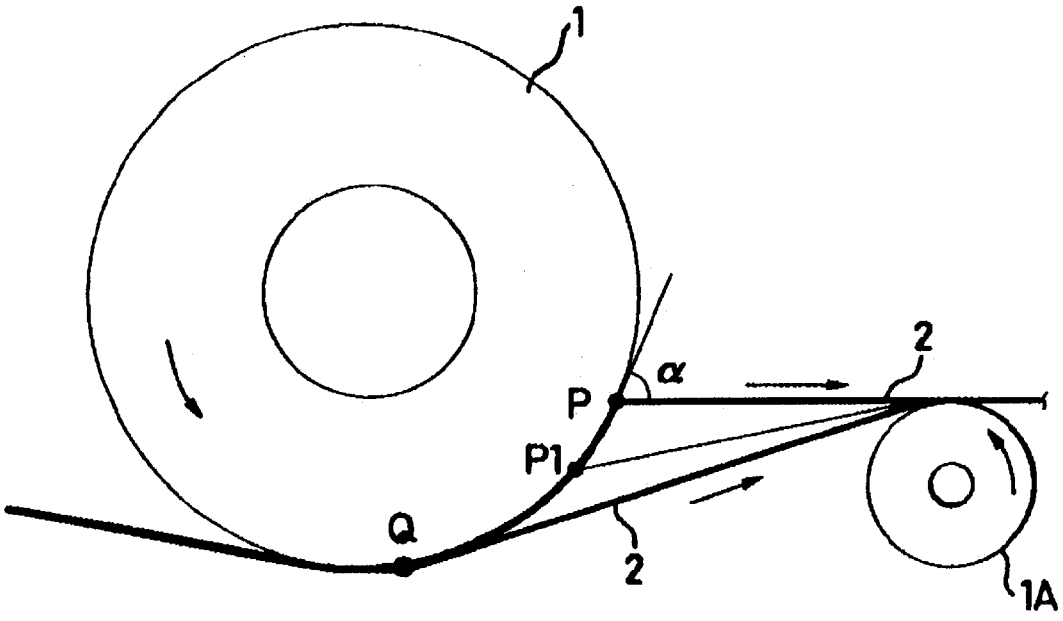
FIG. 8 is an enlarged view of the over-adhesion.

As a result, the releasability of the paper from the press surface was improved, and, in comparison with the state before the application of this technique, the released point was moved 30 mm down from P to P1 (see FIG. 8), the released angle a decreased, and the draw decreased from 1.8% to 1.7%.

The amount of dirty-remains produced decreased from 320 g to 8 g per day, and the frequency of sheet break decreased from eight to five times per month.

The limit of the usable time of the doctor blade extended from 96 hours to 210 hours, i.e., about two to three times, because of wear reduction.

Embodiment 2

Wire paper machine (made by Kobayashi Seisakusho)

In corrugated-paper making, the machine was run for one month and a paper release improving agent was continuously sprayed onto a press surface through a nozzle of an opposed type spraying device after a doctor blade.

The paper release improving agent used herein is a 20% emulsified water solution in which wax (microcrystalline wax, melting point of 50° C.) and a surfactant are mixed at the ratio of 8 to 2 by weight and are diluted five times with water.

The 400-times-diluted solution was sprayed to the press roll surface by the fixed spraying device at 2000 cc per minute (density of 1 g/cc).

Accordingly, the amount of wax supplied here is $$2000\ \text{g/minute} \times 1/400 \times 20/100 \times 8/10 = 0.8\ \text{g/minute}$$

The printability and quality of the paper (corrugated base paper) produced during this time were inspected. However, there was no influence because of its minute amount of 0.6 $mg/m^2$.

The amount of wax sprayed here, calculated on the basis of passing paper (paper speed 400 m/minute×paper width 3.5 m=amount of paper 1400 $m^2$/minute), is $$0.8\ \text{g/minute} \times 1/1400\ m^2/\text{minute} \approx 0.6\ mg/m^2$$

In this machine, the releasability of the paper was bad, and the sheet break in the press section occurred three to four times per day on average, because the raw material for paper making was 100%. old waste paper, which contains much gum pitch resulting from the fact that it is recycled five to six times nowadays.

However, as a result of the application of this technique, the releasability of the paper from the press surface was improved, the released point was moved 10 mm to 45 mm down from P to P1, and the draw decreased 0.5%.

The frequency of sheet break decreased from 105 to 65 last month, and productivity climbed 8.7%.

The amount of dirty-remains produced decreased from 85 g to 12 g per day, the wear of the doctor blade decreased by half, and the use time of the doctor blade doubled.

Embodiment 3

(Example Where the Amount of Wax to be Sprayed is Raised and Changed)

The same processing as in embodiment 1 was carried out except that the amount of wax to be sprayed is 1.0 $mg/M^2$ and 5.0 $mg/M^2$.

The amount of dirty-remains produced was 5 g in the case of 1.0 $mg/m^2$ and 3 g in the case of 5.0 $mg/m^2$. The life of the doctor blade also showed an improved tendency from the result of 280 hours in the case of 1.0 $mg/m^2$ and 320 hours in the case of 5.0 $mg/m^2$.

Embodiment 4

(Example Where the Amount of Wax to be Sprayed is Reduced and Changed)

The same processing as in embodiment 1 was carried out except that the amount of wax to be sprayed is 0.1 $mg/m^2$ and 0.02 $mg/m^2$.

The amount of dirty-remains produced was 15 g in the case of 0.1 $mg/m^2$ and 50 g in the case of 0.02 $mg/m^2$ per day.

The life of the doctor blade was 180 hours and 140 hours.

Comparative Example 1

(Comparison with water)

Under the same conditions as in embodiment 1, a paper release improving agent was not sprayed, and only water was sprayed for one month.

The effect of improving paper release was not gained by spraying only water, and the released point returned to its pre-wax-spraying state (i.e., increased) 12 minutes after the start of operation.

However, the remains on the press surface decreased, and the amount of dirty-remains produced was 160 g per day. When stopped, the state of the press surface was observed. As a result, less waste had stuck to the press surface than in comparison with the case where no water is sprayed. In other words, it was confirmed that water spraying is effective in removing such dirty remains.

On the other hand, there was no effect to reduce the wear of the doctor blade, and the limit of the usable time was 96 hours.

Comparative Example 2

(Comparison with High Melting Point Wax)

Under the same conditions as in embodiment 1, a paper release improving agent of high melting point wax (melting point of 85° C.) was sprayed for one month.

Since the melting point of the wax was higher than the temperature of the press surface, the wax particles did not dissolve, and they stuck to the press surface in the form of solid particles. The press surface became cloudy, and the effect of improving paper release was not gained.

The released point returned (i.e., increased) to P1 of the pre-wax-spraying state 12 minutes after the start of operation by spraying water.

The amount of dirty-remains produced was 170 g per day. When stopped, the state of the press surface was observed. As a result, it was in a contaminated state because of the adhesion of the solid wax particles.

However, the wear of the doctor blade decreased, and the limit of the usable time doubled.

Comparative Example 3

(Example Where the Amount of Wax to be Sprayed is Excessive)

The same processing as in embodiment 1 was carried out except that the amount of wax to be sprayed is 20 $mg/m^2$.

The amount of dirty-remains produced was 3 g, and the life of the doctor was 320 hours.

However, disadvantageously, since an excessive amount of wax was supplied to the paper surface, a harmful effect occurred where the fixing properties of ink are lowered in a subsequent printing step.

Comparative Example 4

(Example Where the Amount of Wax to be Sprayed is Deficient)

The same processing as in embodiment 1 was carried out except that the amount of wax to be sprayed is 0.005 $mg/m^2$.

However, the dirty-remains appearing on the blade edge of the doctor was not different from comparative example 1 (case of water only), and the life of the doctor blade was also almost the same.

Although the present invention was described as above, it is not limited to the performed modes and the embodiments set forth herein. The present invention, of course, is susceptible of other various modifications without departing from the spirit of this disclosure.

For example, an object to which a paper release improving agent is supplied was described as a press roll, but, without being limited to this, the invention is definitely applicable to a roll, such as a guide roll, in which over-adhesion is caused by direct contact with paper.

Industrial Applicability

Although the present invention is a technique applied to a press roll used in a paper machine, it is applicable to a field to expect a similar effect in the entire manufacturing technology of paper.

What is claimed is:

1. A method of, in a press roll in a state in which paper is being supplied by driving a paper machine, preventing over-adhesion of the paper onto a surface of the press roll, wherein a fixed amount of paper release improving agent mainly composed of wax having a melting point of not more than 60° C. which is lower than a surface temperature of the press roll is continuously supplied to the surface of the rotating press roll in an amount of 0.01 to 10 mg/m$^2$, calculated on the basis of passing paper.

2. The method of claim 1, wherein a substance in which wax is emulsified with a surfactant is used as the paper release improving agent.

3. The method of claim 1, wherein the wax used as the paper release improving agent comprises one or more substances selected from the group of paraffin wax, microcrystalline wax, vaseline, composite wax, alkane pure goods (C17–C27), α-olefin, alkene pure goods (C19–C29), and animal/plant base glycerides.

4. The method of claim 1, wherein the paper release improving agent is supplied to the surface of the press roll by spraying.

5. A method of preventing over-adhesion of paper onto a surface of a press roll of a paper machine, said method comprising:

providing a release agent composed primarily of wax having a melting point which is lower than a surface temperature of the press roll and not more than 60° C.; and continuously supplying the release agent directly onto the surface of the rotating press roll when paper is being supplied thereto in an amount of 0.01 to 10 mg/M$^2$, which amount is calculated based upon parameters of the paper being supplied to the press roll.

6. The method of claim 5 wherein the step of providing the release agent further includes providing a wax having a melting point in the range of 25° C. to 60° C.

7. The method of claim 5 further including emulsifying the wax with a surfactant.

8. The method of claim 5 wherein said step of providing the release agent further includes providing a wax comprising at least one of: paraffin wax, microcrystalline wax, vaseline, composite wax, alkane; pure goods (C17–C27), α-olefin, alkene pure goods (C19–C29), and animal/plant based glycerides.

9. The method of claim 5 wherein said step of continuously supplying includes spraying the release agent onto the surface of the rotating press roll.

10. The method of claim 9 further including melting the wax with surface heat of the press roll to form a wax film on the surface thereof, gradually transferring the wax film to the paper by pressing the paper against the press roll such that the wax film is gradually worn down, and thereafter replenishing the surface of the press roll with wax to maintain the wax film thereon.

11. The method of claim 5 wherein the parameters of the paper supplied to the press roll are paper speed and paper width.

* * * * *